US009938061B2

(12) United States Patent
Garthe

(10) Patent No.: US 9,938,061 B2
(45) Date of Patent: Apr. 10, 2018

(54) LOCKOUT BOX

(71) Applicant: ABUS August Bremicker Sohne KG, Wetter-Volmarstein (DE)

(72) Inventor: Bernhard Garthe, Gevelsberg (DE)

(73) Assignee: ABUS AUGUST BREMICKER SOHNE KG, Wetter-Volmarstein (DE)

( * ) Notice: Subject to any disclaimer, the term of this patent is extended or adjusted under 35 U.S.C. 154(b) by 0 days.

(21) Appl. No.: 14/701,308

(22) Filed: Apr. 30, 2015

(65) Prior Publication Data

US 2015/0314933 A1 Nov. 5, 2015

(30) Foreign Application Priority Data

May 5, 2014 (DE) ..... 10 2014 106 228

(51) Int. Cl.

| | |
|---|---|
| ***B65D 55/14*** | (2006.01) |
| ***B65D 25/28*** | (2006.01) |
| ***B65D 85/00*** | (2006.01) |
| ***E05B 65/52*** | (2006.01) |
| ***B65D 43/16*** | (2006.01) |
| ***B65D 25/22*** | (2006.01) |
| ***E05G 1/04*** | (2006.01) |
| ***E05G 1/00*** | (2006.01) |
| ***B25H 3/02*** | (2006.01) |

(52) U.S. Cl.

CPC ..... *B65D 55/14* (2013.01); *B25H 3/02* (2013.01); *B65D 25/22* (2013.01); *B65D 25/28* (2013.01); *B65D 43/16* (2013.01); *B65D 85/70* (2013.01); *E05B 65/52* (2013.01); *E05G 1/005* (2013.01); *E05G 1/04* (2013.01)

(58) Field of Classification Search

CPC ..... B65D 55/14; B65D 25/22; B65D 25/28; B65D 43/16; B65D 85/70; B25H 3/02; E05B 65/52; E05B 1/005; E05B 1/04

USPC ..... 206/1.5

See application file for complete search history.

(56) References Cited

U.S. PATENT DOCUMENTS

| | | | | |
|---|---|---|---|---|
| D539,633 | S | 5/1895 | Murphy | |
| 1,634,884 | A * | 7/1927 | Peer | E05G 1/005 109/51 |
| 2,754,991 | A * | 7/1956 | Hagerty | B61D 35/00 220/481 |

(Continued)

FOREIGN PATENT DOCUMENTS

| | | |
|---|---|---|
| CN | 2432118 Y | 5/2001 |
| CN | 2445719 Y | 9/2001 |

(Continued)

*Primary Examiner* — Chun Cheung

(74) *Attorney, Agent, or Firm* — Amster, Rothstein & Ebenstein LLP

(57) ABSTRACT

A lockout box for locking in objects, in particular keys, comprises a container having an upwardly open reception space for the objects and comprises a cover attached, in particular pivotably, to the container for closing the reception space, wherein the cover is adjustable from a closed position in which the reception space is closed into at least one open position in which the reception space is open, with a plurality of securing openings being provided in the cover and in the container for attaching a plurality of locking elements, in particular padlocks, and with at least one fastening device being provided at the container and being designed to attach the container to a wall.

22 Claims, 3 Drawing Sheets

(56) References Cited

U.S. PATENT DOCUMENTS

Figure 1:
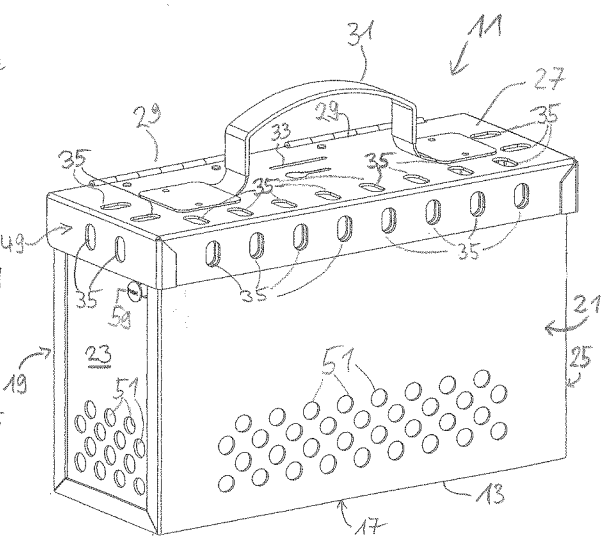

| | | | | |
|---|---|---|---|---|
| 5,033,634 | A * | 7/1991 | Batchelor | B65D 50/045 206/1.5 |
| 5,738,020 | A | 4/1998 | Correia | |
| 5,870,910 | A | 2/1999 | Specht et al. | |
| 7,299,667 | B1 | 11/2007 | Miresmaili | |
| 7,360,380 | B2 | 4/2008 | Van Handel | |
| 8,322,566 | B2 | 12/2012 | Hackett | |
| 2004/0232040 | A1* | 11/2004 | Bowling | A63F 9/0495 206/775 |
| 2005/0199628 | A1 | 9/2005 | Van Handel et al. | |
| 2006/0162403 | A1 | 7/2006 | Handel | |
| 2007/0277713 | A1 | 12/2007 | Miresmaili | |
| 2010/0147853 | A1 | 6/2010 | Hackett | |
| 2012/0074158 | A1 | 3/2012 | Lafleur | |
| 2013/0099641 | A1 | 4/2013 | Saucier et al. | |

FOREIGN PATENT DOCUMENTS

| | | | |
|---|---|---|---|
| CN | 1957152 | A | 9/2005 |
| CN | 101061045 | A | 10/2007 |
| CN | 101963006 | A | 6/2010 |
| DE | 200 05 938 | U1 | 11/2000 |
| EP | 1807592 | B1 | 11/2005 |
| WO | 20121097994 | A1 | 7/2012 |

* cited by examiner

LOCKOUT BOX

The present invention relates to a lockout box for locking in objects, in particular keys, which comprises a container, in particular a parallelepiped container, having an upwardly open reception space for the objects and a cover attached, in particular pivotably, to the container for closing the reception space, wherein the cover is adjustable from a closed position in which the reception space is closed into at least one open position in which the reception space is open, with a plurality of securing openings being provided in the cover and in the container for attaching a plurality of locking elements, in particular padlocks.

Such a lockout box is, for example, known from U.S. Pat. No. 8,322,566 B2. A lockout box of the initially named kind is also called a "lock box".

A lockout box of the initially named kind is typically used for a so-called group lockout in connection with a maintenance, a repair or a cleaning of a machine or of a plant when a plurality of employees participating in the maintenance, the repair or the cleaning have to lock out one or more sources of energy at the machine or at the plant. In order to keep the effort in time for the lockout and the number of necessary safety locks as low as possible, the individual sources of energy are each only locked with one safety lock in a group lockout. The keys of these locks are then locked in into the lockout box. Each employee hangs his personalized lock at the outside into securing openings provided for this purpose and locks it such that the lockout box can no longer be opened. Each employee thus does not have to hang his respective lock at each locked out source of energy, but rather only once at the lockout box—without the intention of a "lock out" and/or the safety achieved thereby being impaired. The sources of energy can only be actuated again when all employees have removed their locks from the lockout box after completing their work, as the lockout box can only then be opened again and the keys stored therein can be removed for unlocking the locks at the sources of energy.

The present invention is based on the object of providing a lockout box which is easy to use, in particular for increasing the lockout safety related to the use of the lockout box.

The object is satisfied by a lockout box having the features of the claim 1 and in particular in that a lockout box of the initially named kind is further developed in that at least one fastening device is provided at the container which is designed and/or provided to attach the container to a wall.

The container can thus be releasably fastened to the wall, in particular in a manner such that it can be hung, and/or in a removable manner or in a permanent and/or fixed manner. A defined position is provided for the lockout box through the attachment to the wall such that one does not have to search for long for the lockout box for a lockout. In addition, all the persons participating in the lockout know the storage space of the lockout box and can thus attach their padlock to the lockout box without having to search for too long.

The lockout box can be placed in the proximity of a plant or of a machine and can thereby be associated with the plant or with the machine. It is thus possible to assign an own lockout box to each plant or to each machine, with the lockout box only being used for a lockout to be carried out at the respective plant or machine and being made available at its provided position for this purpose.

In this respect, it is advantageous if a label is attached to the lockout box via which it can be recognized which plant or which machine the lockout box is associated with. In this connection, it is furthermore of advantage if padlocks having RFID transponders, as they are described in WO 2012/097994 A1, are used for the lockout of the plant or of the machine.

The lockout box can be removed from the wall on a releasable attachment to the wall and can thus be used in a semi-mobile manner, this means in a stationary manner and also in a mobile manner. The lockout box can, however, also be provided only for stationary use in that it is fixedly attached, for example screwed, to a wall. In addition, the lockout box can also only be provided for mobile use when it is not attached to the wall.

The semi-mobile use and/or stationary use of the lockout box offers the advantage that a defined position is provided at the wall for the lockout box. The lockout box and the keys which are possibly locked in can thus not get lost. Thereby the security with a lockout is increased, since the lockout box with the locked in keys is stored at a defined, obvious position at the wall during the lockout and the choice of the location is not left to the arbitrariness or to the sole discretion of the user, whereby a removal of the lockout box due to manipulation or to a lack of attention by involved persons or by third parties is made more difficult. Each employee participating in the lockout exactly knows where the lockout box hangs during the lockout, due to the defined location, and where he can remove his personalized lock again after completing his work. After the completion of a lockout, a person in charge can furthermore collect the locks used for the lockout again and stow them in the lockout box such that the keys are available again for a future lockout without a long search.

In this connection, it is advantageous if the lockout box is always made available with a plurality of padlocks stored in the lockout box container, since the padlocks are then immediately available for a lockout to be carried out and do not have to be searched for long and/or acquired separately. The dimensions of the supplied padlocks can furthermore be adapted to the dimensions of the lockout box. The diameter of the hoops of the padlocks can, for example be adapted to the diameter of the securing openings provided in the cover and in the container such that the padlocks are designed in a manner adapted to the lockout box.

The lockout box is in particular a standard group lockout box which has a comparatively small volume and is dimensioned such that it is approximately twice as wide as it is deep.

In the state mounted at the wall, the cover is also preferably adjustable from the closed position, in particular by at least approximately 90 degrees or more, into the open position. The container therefore does not necessarily have to be removed from the wall or from a wall holder before the cover can be opened sufficiently wide.

Preferably a wall holder fastenable, in particular screwable, to a wall is provided for the container to which the container is attachable, in particular releasably attachable. The lockout box can thus be attached to the wall holder, and thus at a defined position, for storage and can be removed and used in a mobile manner as required, in particular for the use for a group lockout. The lockout box can thus be used in a semi-mobile manner, that is in a stationary manner and also in a mobile manner.

The container can comprise a container base, a rear side wall, a front side wall disposed opposite the rear side wall and lateral side walls in the form of a left side wall and a right side wall which define the reception space and give the container a shape, in particular a parallelepiped shape. The lockout box has a particularly high stability and steadfastness due to the design of the container in the shape of a parallelepiped having four side walls and a rectangular container base.

The wall holder preferably holds the container at a spacing from the wall, with the wall holder preferably comprising a U-shaped hoop having side limbs whose length defines the spacing of the container from the wall. The limbs are therefore sufficiently long to be able to hold the container so far away from the wall that the cover can be brought into the open position when the container is attached to the wall holder. The dimensions of the wall holder are in particular tailored to the dimensions of the cover, in particular including the dimensions of a carry handle, such that the cover is adjustable from the closed position into the open position.

The fastening device preferably comprises at least one holding element attachable, in particular screwable, or attached to a rear side wall of the container, the holding element in particular being in the form of a holding hook directed downwardly at a spacing from the side wall, wherein the holding element is able to be hung into the wall holder for the attachment of the container to a wall holder. By means of the holding element, the container can be hung into the wall holder in an intuitively simple manner or can be removed again easily from the wall holder for the mobile use.

The holding element can be screwed to or also welded to the rear side wall. The holding element is fixedly connected to the container by means of the welding.

The container can have a security against removal which is adjustable between a removable position and a blocked position, with the security against removal being configured in such a way that the container attached to the wall holder is removable from the wall holder in the removable position and is secured against a removal from the wall holder in the blocked position. By means of the security against removal, the container can thus be secured, as required, against the removal from the wall holder, whereby a loss of the container can be avoided.

It is particularly advantageous in this respect when the holding element is welded to the rear side wall of the container for the hanging in of the container at the wall holder, as the container cannot be removed from the wall holder by an unscrewing of the holding element when the security against removal is in the blocked position. The lockout box can thus be designed as particularly secure against theft.

The security against removal can be adjustable between the removable position and the blocked position via an actuation mechanism attached in the reception space, in particular via a switch, a button or a lever. Since the actuation mechanism is attached in the reception space, the security against removal can only be actuated with an open cover. The container secured against its removal can thus not be removed from the wall holder during a lockout, since the actuation mechanism for adjusting the security against removal into the removable position cannot be reached. It must therefore be decided before a lockout whether the container should be secured at the wall holder via the security against removal, as following the closing of the cover at the container the actuation mechanism is only accessible again after the completion of the lockout and with a cover which is open again.

The security against removal preferably has a blocking element, in particular a pin, which can be moved out of the container and which engages from behind, in particular engages from beneath, the wall holder in the blocked position or which engages into a blocking device provided at the wall holder, in particular into an opening, preferably a horizontal elongate hole, or which engages from behind, in particular engages from beneath, such a blocking device to block the removal of the container from the wall holder. In the removable position, the blocking element can be retracted into the container such that the container can be removed from the wall holder. What is advantageous about an opening formed as a horizontal elongate hole is in this respect that a blocking element, such as a blocking pin, can be introduced into the elongate hole without a long search for the opening. The term "to engage from behind" in particular means that the blocking element is moved out from behind the blocking device and/or the wall holder in the direction of removal of the container and the term "to engage from beneath" in particular means that the direction of removal is directed upwardly and that the blocking element engages from behind the blocking device and/or the wall holder from beneath.

In the blocked position, the blocking element preferably in particular additionally engages into an opening, in particular a round hole, formed in a holding element attached to a rear side wall. Viewed from the container, the blocking element can thus initially engage into a horizontal elongate hole in the wall holder and then engage into the round hole in the holding element hung into the wall holder, whereby the container can be fastened to the wall holder in a particularly theft-proof manner. Alternatively the blocking element can also engage from behind, in particular engage from beneath, the wall holder and only engage into the opening formed in the holding element.

In accordance with a preferred embodiment of the invention, the cover is pivotably attached, in particular by means of at least one hinge, to a rear side wall of the container, via which rear side wall the container is fastenable to the wall holder. The cover can in this respect be brought into the open position in combination with the previously mentioned wall holder, even if the container is fastened to the wall holder via the rear side wall. The hinge can in particular be an inner hinge which is mounted at the inner side of the rear side wall. This has the advantage that the cover can also be pivoted upwardly by 90 degrees when the rear side wall directly abuts the wall.

The fastening device can have at least one opening, in particular a throughgoing opening, formed at a rear side wall of the container. The opening can, for example, be formed as a bore into which a fastening part, such as a screw or a nail, can be received, via which fastening part the container is fastenable to the wall. The opening can also be formed as a bore, in particular as a threaded bore, and can be provided for screwing a holding element to the rear side wall.

The opening can also be provided beneath a holding element attached to the rear side wall of the container. The holding element can in this respect be screwed to or welded to the container. The opening disposed beneath the holding element can be at least one screw bore or two screw bores for screwing the container to the wall. On a direct screwing of the container to the wall, the holding element brings about a mounting of the container inclined slightly to the front, whereby the removal of locks and of keys becomes simpler. Furthermore, the open containers can be looked into better from above.

In accordance with a preferred embodiment of the invention, the cover is provided at its outer side with a carry handle which can in particular be folded over and/or which is removable from the cover. The transport of the lockout box is thereby simplified. The carry handle can in particular be folded over to the side when the cover is brought into the open position such that a smaller minimum spacing from the wall is required for the container when the container should also be able to be opened on attachment to the wall holder. The carry handle can be removed if the lockout box has been fastened to a wall for the exclusive stationary use.

In accordance with a further embodiment of the invention which is also claimed separately, the cover is pivotably attached to a rear side wall of the container which has a larger width than the lateral side walls of the container. The rear side wall is thus the longer side with respect to the lateral side walls. The cover is therefore attached along its long side to the container and pivots open via its short side. When the cover is closed by means of a padlock hung into the securing openings, the cover can normally still be slightly raised and a gap can thereby be provided on the basis of a normally available slight clearance between the securing openings and the hoop of a padlock led through the securing openings. However, as the cover is attached via its long side to the container and thus pivots open via its short side, the maximum gap size produced at the front side wall is smaller than with a lockout box in which the cover is attached to a short side wall and thus pivots open via its long side. For this reason, a collar provided at the cover can be formed comparatively short, with the collar covering the upper region of the side walls with a closed cover and preventing an air gap from arising between the cover and the side walls, despite the clearance. Furthermore, the collar does not have to be pulled further downward in the region of the front side wall of the container than in the other regions in order to avoid a possible air gap formation in this region. Material can thereby be saved and the weight of the lockout box can be kept low which in particular simplifies the handling of the lockout box during the mobile use.

Preferably no securing openings for the attachment of padlocks are provided in a rear side wall of the container and in a cover section adjacent to the rear side wall. The attachment of the lockout box to the wall holder can thus not be prevented by a padlock.

A plurality of securing openings can be provided for the attachment of a plurality of padlocks in a front side wall of the container and in a cover section adjacent to the front side wall. A plurality of securing openings can be provided for the attachment of a plurality of padlocks in a right side wall of the container and in a cover section adjacent to the right side wall. A plurality of securing openings can be provided for the attachment of a plurality of padlocks in a left side wall of the container and in a cover section adjacent to the left side wall. Securing openings attached in such a manner are also accessible when the lockout box is attached to the wall holder.

Securing openings are preferably provided for a total of twelve padlocks. This has so-to-say been established as a standard. Securing openings for more than or fewer than twelve padlocks can, however, also be provided.

At least one inspection hole can be formed in, in particular punched into, at least one side wall of the container, preferably in each side wall of the container. A plurality of inspection holes can in particular be provided in each side wall in order to allow light to be incident and to serve as inspection windows. The inspection holes are sufficiently small such that keys cannot fall through them. Inspection holes and/or light holes at all four sides allow the light to be incident from all sides and thus allow a view into the reception space also then when the lockout box hangs at the wall or when bad lighting conditions are present. A weight reduction can moreover be achieved through the introduction of many inspection holes into the container.

In accordance with a further embodiment of the invention which is also claimed separately, in the closed position of the cover, a first closure part which is attached to the inner side of the cover forms a snap-in connection for closing the cover at the container with a second closure part attached to the inner side of a side wall of the container. The cover can be held in the closed position by means of the snap-in connection. The container thus remains closed without a padlock being inserted into the securing openings. This in particular simplifies the transport and the handling of the lockout box.

An actuation element, in particular a push button, which is coupled to the second closure part, can be arranged at the outer side of the side wall of the container by means of which actuation element the snap-in connection can be released between the two closure parts, in particular by means of pressing the push button. The container can thus be intuitively opened.

The second closure part can preferably be deflected from a position of rest into a release position, in which the snap-in connection is released, by means of the actuation element and the second closure part is formed resilient in such a way that, in the release position, the second closure part is acted on by a restoring force into the position of rest. After the actuation of the actuation element, the second closure part thus automatically returns to its position of rest and/or its starting position. The snap-in connection can thus be formed again when the cover is closed again.

At least one spring is preferably provided which preloads the cover in the direction of the open position. The cover thus so-to-say opens on its own when the actuation element is actuated. The spring additionally holds the cover in the open position which simplifies the access to the reception space.

The width of the rear side wall preferably lies in the range between twice and three times, preferably at least approximately 2.5 times, the width of the lateral side wall. The same is accordingly true for the width of the front side wall. The front side wall and the rear side wall can, for example, each have a width of approximately 23 cm, whereas the lateral side walls can each be approximately 9 cm wide.

Figure 2:
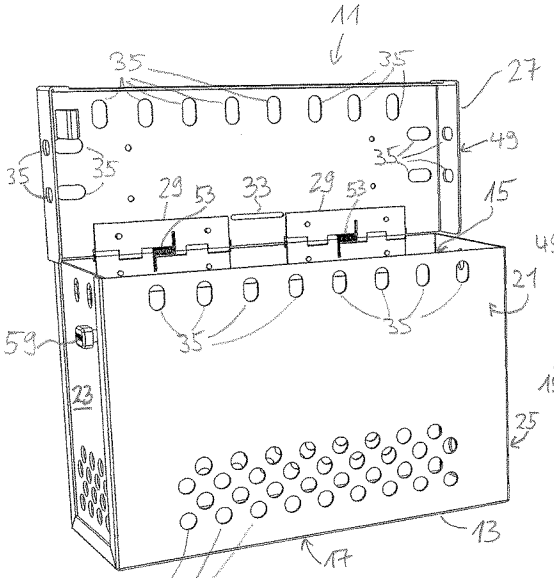
Figure 3:
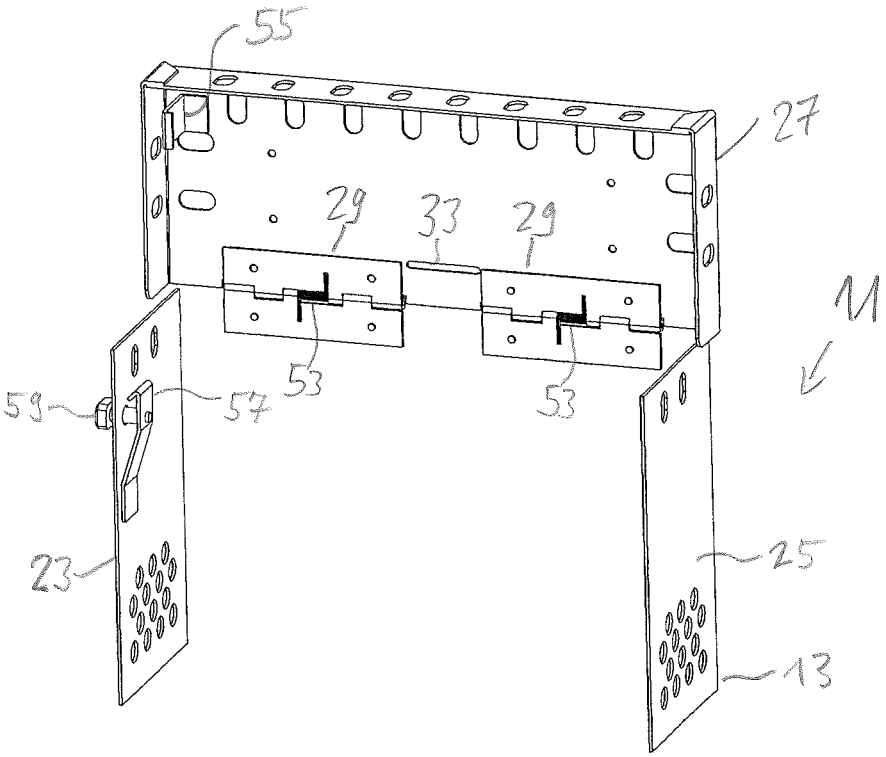
Figure 4:
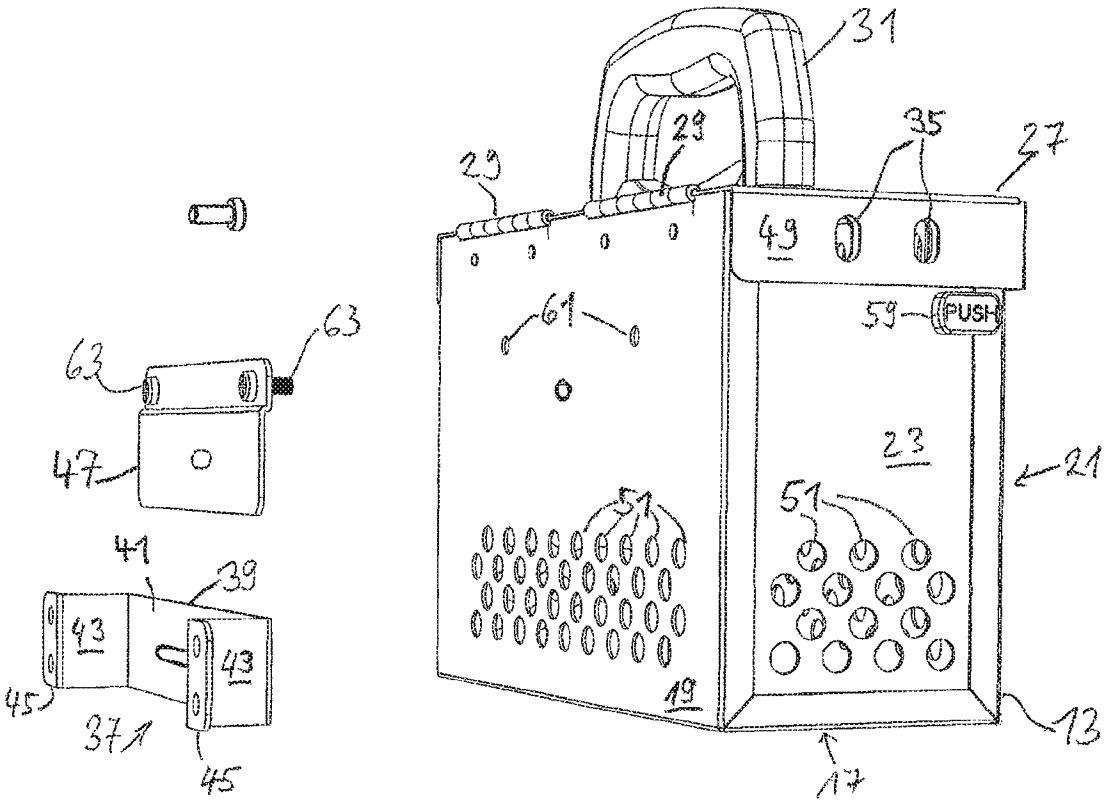

The invention will be described by way of example in the following with reference to an advantageous embodiment and by means of the enclosed drawings. There are shown, schematically in each case, FIG. 1 a perspective view of an embodiment of a lockout box in accordance with the invention having a closed cover;

FIG. 2 a perspective view of the lockout box of FIG. 1 having an open cover;

FIG. 3 a further perspective view of the lockout box of FIG. 1, with parts of the lockout box having been omitted for better visibility of a closure element; and FIG. 4 a perspective view of a modified variant of the lockout box of FIG. 1 having a wall holder.

The lockout box 11 shown in FIGS. 1 to 4 comprises a parallelepiped container 13, having an upwardly open reception space 15. The container 13 is in this respect formed by a container base 17, a rear side wall 19, a front side wall 21, a left side wall 23 and a right side wall 25. The container base 17 and the side walls 19, 21, 23 and 25 define respectively surround the reception space 15. In the lockout box 11 shown, a cover 27 is pivotably fastened to the rear side wall 19 of the container 13 via two hinges 29.

As FIGS. 1 and 2 show, the cover 27 is adjustable from a closed position (cf. FIG. 1) in which the reception space 15 is closed into an open position (cf. FIG. 2) in which the reception space 15 is open. In the open position, the cover 27 faces upwardly and is in this respect pivoted at least approximately by 90° with respect to the closed cover 27 shown in FIG. 1.

A carry handle 31 is arranged at the outer side of the cover 27 which is fixedly attached to the outer side of the cover 27 in FIGS. 1 and 2. In contrast to this, the carry handle 31 can be folded over to the side in the variant of FIG. 4 such that the carry handle 31 can be flipped over from the carrying position shown in FIG. 4 to the rear or to the front in the direction of the rear side wall 19 or in the direction of the front side wall 21. What is not shown is a carry handle 31 which is releasably fastened to the cover 27 by means of screws and optionally by means of nuts and which can thus be removed from the cover 27. This can be of advantage when the container 13 is permanently fastened to a wall.

The lockout box 11 is a group lockout box. The lockout box 11 is used in a so-called group lockout in which a plurality of employees participating in a maintenance, a repair or a cleaning of a machine or of a plant or of another installation have to secure and/or lock out one or more sources of energy. In order to keep the effort in time for the lockout of such sources of energy and the number of necessary locks for the lockout of sources of energy as small as possible, the individual sources of energy in the group lockout are each only locked with one safety lock. The keys of these locks are then locked in into the lockout box 11. The lockout box 11 in particular has a slit 33 at the cover 27 to throw keys into a lockout box 11 which is already closed or is still closed.

The lockout box 11 has a plurality of securing openings 35 in the cover 27 and in the container 13 into which the padlocks can be hung. In a group lockout, each of the involved employees hangs his personalized padlock into a set of three securing openings 35 corresponding with one another with a closed cover 27 and thus locks the cover 27 in the closed position at the container 13. Each employee thus does not have to hang his lock at each locked out source of energy, but rather only once at the lockout box 11, without the intention of the lockout and the security achieved by the lockout being impaired.

The sources of energy can only be actuated again when all employees have removed their padlocks from the lockout box 11 again after completing their work and have thus released the cover 27 again. The cover 27 can then be brought into the open position again in order to remove the locked in keys of the safety locks attached to the sources of energy.

In order to be able to comfortably transport the lockout box 11, for example during a lockout, this means during an actual lockout, the lockout box has the already mentioned carry handle 31. The container 13 is additionally releasably attachable to a wall holder 37 (cf. FIG. 4), for example, for storing the lockout box 11. The wall holder 37 can be screwed to a wall (or also to a housing of a plant or of a machine or the like) such that the lockout box 11 can be stored at a defined position. However, the lockout box 11 can also be removed again simply and quickly from the wall holder 37 for the use.

The wall holder 37 is configured in the form of a U-shaped hoop 39. The hoop 39 has a front section 41 at whose two side ends, side limbs 43, which are arranged at an angle of 90° with respect to the front section 41, move to the rear and are in turn angled at their end remote from the front section 41. The angled range in this respect forms an assembly section 45 for fastening the wall holder 37 to the wall, for example, by means of screwing.

A holding hook 47 can be attached to the outer side of the rear side wall 19 by means of screws 63. The screws 63 are for this purpose, for example, inserted through the openings 61 provided at the rear side wall 19 of the container 13 and are secured by means of nuts. The holding hook 47 is downwardly directed at a small spacing away from the side wall 19 such that the holding hook 47 can be hung into the front section 41 of the hoop 39 in order to attach the container 13 and/or the lockout box 11 to the wall holder 37. Alternatively the openings 61 can be used to screw the container 13 directly to the wall, that is without a wall holder, and thus to fasten the container 13 permanently to the wall for the stationary use.

The wall holder 37 is configured such that the container 13 is held at a spacing from the wall which is sufficiently large to pivot the cover 27 from the closed position by 90 degrees into the open position. The carry handle 31 can in this respect in particular be flipped over, whereby the required spacing is smaller than with carry handles which cannot be flipped over. In order to provide the said spacing, the limbs 43 are sufficiently long in the example shown such that the container 13 is held at a spacing from the wall which is sufficient to open the cover 27 with a container 13 attached to the wall holder 37.

The cover 27 can, however, also be pivoted upwardly by 90 degrees without a wall holder and/or without a spacer in particular when the hinge 29, as FIG. 2 shows, is attached to the inner side of the rear side wall 19.

As is in particular shown in FIGS. 2 and 3, the rear side wall 19 or the front side wall 21 is the longer side in comparison with the right side wall 23 or the left side wall 25. The rear side wall 19 thus has a larger width than the side walls 23, 25. For this reason, the cover 27 is hinged at a long side of the container 13.

When the cover 27 is opened, its short sides thus pivot upwardly. When a padlock is hung into a set of securing openings 35, a slight clearance between the hoop of the padlock and the three securing openings 35 is normally present. In order to avoid an air gap from arising between the cover 27 and the side walls 21, 23, through which air gap a key could fall to the outside, due to the clearance, the cover 27 has a collar 49 which is pulled downwardly at the front edge and at the side edges of the cover 27 and which covers an upper region of the side walls 21, 23 and 25 with a closed cover 27.

As the cover 27 is hinged at its long side and pivots open via its short sides, a gap between the cover section of the cover 27 and the upper region of the side walls 21, 23, 25 is smaller than with a cover which is hinged at its short side. For this reason, the collar 49 can be comparatively short and can be formed with a constant depth viewed in the peripheral direction of the cover 49, whereby material can be saved and the weight of the lockout box 11 can be kept low. The collar 49 in particular does not have to be pulled further downward in the region of the front side wall 21 than in the other regions, as an air gap also cannot arise in the region of the front side wall 21.

In the lockout box 11, no securing openings 35 are provided for hanging padlocks at the rear side wall 19 and at a cover section adjacent to the rear side wall 19. In contrast to this, in the front side wall 21 and in a cover section adjacent to the front side wall 21, in the left side wall 23 and in a cover section adjacent to the left side wall, and in the right side wall 25 and in a cover section adjacent to the right side wall, a total of twelve securing openings 35 are formed to be able to attach a total of twelve padlocks to the lockout box 11. The attachment of the securing openings 35 at the front and at the side of the lockout box 11 has the advantage that all securing openings are also easily accessible with a container 13 attached to the wall holder 37.

In each of the side walls 19, 21, 23, 25 of the container 13, a plurality of inspection holes 51 are punched in a lower region of the respective side wall. Light can enter from all sides into the reception space 15 through the inspection holes 51 such that the reception space 15 is easily visible even with a closed cover 27 and with a container 13 hanging at the wall or with bad lighting conditions. The inspection holes 51 are sufficiently small such that no key can fall through the inspection holes 51.

As FIGS. 2 and 3 show, a spring is arranged in the region of each hinge 29 such that the spring preloads the cover 27 in the direction of the open position.

In order to be able to hold the cover 27 in the closed position with padlocks which are not hung, an additional closure is provided having a first closure part 55 which is attached to the inner side of the cover 27 and which, in the closed position of the cover 27, forms a snap-in connection for closing the cover 27 at the container 13 with a second closure part 57 attached to the inner side of the left side wall 23. The two closure parts 55, 57 are in this respect preferably configured in the form of two snap hooks cooperating with one another, as FIG. 3 shows. A push button 59 is arranged at the outer side of the side wall 23, with the push button being supported via a bolt or the like at the snap hook forming the second closure part 57. If the push button 59 is pressed, then the snap hook 57 is pressed away from the left side wall 23 to the inside, whereby the snap-in connection having the snap hook forming the first closure part 55 is released such that the cover 27 can be opened and/or opens on its own on the basis of the preload effected by the springs 53. As the snap hook 57 is resilient, the snap hook 57 moves back into its starting position again after the push button 59 has been released.

The container 13 and the cover 27 preferably comprise powder-coated steel. The first closure part 55 and the second closure part 57 preferably comprise a resilient material, in particular spring steel. The wall holder 37 and the holding hoop 47 preferably comprise a metal sheet and can also be powder coated.

The lockout box 11 can be carried and can be stowed at a defined position via the wall holder 37. The lockout box 11 can, however, also be fastened directly, in particular screwed, to a wall without a wall holder 37. The lockout box 11 can be formed with a low weight and it can be opened intuitively through the actuation of the push button 59. As mentioned above, the lockout box is in particular suitable for the so-called group lockout in which a plurality of employees participating in a maintenance, a repair or a cleaning have to lock out a plurality of sources of energy. Since the lockout box 11 can be stored, for example via the wall holder 37 at a defined position, such a lockout box 11 can be provided for every larger machine or every larger plant having a plurality of sources of energy, with the lockout box being attached to the wall in the proximity of the machine or of the plant and possibly even being able to serve for the storage of the necessary locks, hasps, locking mechanisms and other devices required for the lockout of the sources of energy. In this way, all required lockout apparatuses can be accessed directly in the case of application, whereby a time-consuming search is omitted and the organization of the lockout is simplified. This is then in particular advantageous when external companies are participating in the lockout which are frequently not able to plan or to estimate the number of necessary locks for the lockout in advance. Lockouts can be accelerated and downtimes and machine service times can thus be reduced by lockout boxes in accordance with the invention.

REFERENCE NUMERAL LIST

11 lockout box
13 container
15 reception space
17 container base
19 rear side wall
21 front side wall
23 left side wall
25 right side wall
27 cover
29 hinge
31 carry handle
33 slit
35 securing opening
37 wall holder
39 hoop
41 front section
43 limb
45 assembly section
47 holding hoop
49 collar
51 inspection hole
53 spring
55 first closure part
57 second closure part
59 push button
61 opening
63 screw

The invention claimed is:

1. A lockout box for locking in objects, comprising:

a container having an upwardly open reception space for the objects;

a cover attached to the container for closing the reception space, wherein the cover is adjustable from a closed position in which the reception space is closed into at least one open position in which the reception space is open;

a plurality of securing openings provided in the cover and in the container for attaching a plurality of locking elements;

at least one fastening device at the container configured to attach the container to a wall;

a wall holder fastenable to a wall provided for the container to which the container is attachable, wherein the wall holder holds the container at a spacing from the wall and the wall holder comprises a U-shaped hoop having side limbs whose length defines the spacing of the container from the wall, wherein the fastening device comprises at least one holding element attachable or attached to a rear side wall of the container, the holding element configured to be hung into the wall holder from above for the attachment of the container to the wall holder, and wherein the container has a security against removal which is adjustable between a removable position and a blocked position, with the security against removal being configured such that the container attached to the wall holder is removable from the wall holder in the removable position and is secured against a removal from the wall holder in the blocked position, wherein the security against removal comprises a pin which engages into an elongate hole provided at the wall holder to block the removal of the container from the wall holder.

2. The lockout box in accordance with claim 1, wherein, in the state mounted at the wall, the cover is also adjustable from the closed position into the open position.

3. The lockout box in accordance with claim 1, wherein, in the blocked position, the pin engages into an opening formed in the holding element attached to a rear side wall.

4. The lockout box in accordance with claim 1, wherein the cover is pivotably attached to a rear side wall of the container via which the container is fastenable to the wall.

5. The lockout box in accordance with claim 1, wherein the fastening device has at least one opening formed at a rear side wall of the container.

6. The lockout box in accordance with claim 5, wherein the opening is provided beneath the holding element attached to the rear side wall of the container.

7. The lockout box in accordance with claim 1, wherein the cover is provided at an outer side with a carry handle.

8. The lockout box in accordance with claim 1, wherein no securing openings for the attachment of padlocks are provided in a rear side wall of the container and in a cover section adjacent to the rear side wall.

9. The lockout box in accordance with claim 1, wherein the plurality of securing openings are provided for the attachment of a plurality of padlocks in a front side wall of the container and in a cover section adjacent to the front side wall; and/or the plurality of securing openings are provided for the attachment of a plurality of padlocks in a right side wall of the container and in a cover section adjacent to the right side wall; and/or the plurality of securing openings are provided for the attachment of a plurality of padlocks in a left side wall of the container and in a cover section adjacent to the left side wall.

10. The lockout box in accordance with claim 1, wherein at least one inspection hole is formed in at least one side wall of the container.

11. The lockout box in accordance with claim 1, wherein at least one spring is provided which preloads the cover in the direction of the open position.

12. The lockout box in accordance with claim 1, wherein the cover is pivotably attached to a rear side wall of the container and the rear side wall has a larger width than the lateral side walls of the container.

13. The lockout box in accordance with claim 12, wherein no securing openings for the attachment of padlocks are provided in a rear side wall of the container and in a cover section adjacent to the rear side wall.

14. The lockout box in accordance with claim 12, wherein the plurality of securing openings are provided for the attachment of a plurality of padlocks in a front side wall of the container and in a cover section adjacent to the front side wall; and/or the plurality of securing openings are provided for the attachment of a plurality of padlocks in a right side wall of the container and in a cover section adjacent to the right side wall; and/or the plurality of securing openings are provided for the attachment of a plurality of padlocks in a left side wall of the container and in a cover section adjacent to the left side wall.

15. The lockout box in accordance with claim 12, wherein at least one inspection hole is formed in at least one side wall of the container.

16. The lockout box in accordance with claim 12, wherein at least one spring is provided which preloads the cover in the direction of the open position.

17. The lockout box in accordance with claim 12, wherein the width of the rear side wall is in a range between twice and three times the width of the lateral side walls.

18. The lockout box in accordance with claim 1 wherein, in the closed position of the cover, a first closure part which is attached to the inner side of the cover forms a snap-in connection for closing the cover at the container with a second closure part attached to the inner side of a side wall of the container.

19. The lockout box in accordance with claim 18, wherein an actuation element, which is coupled to the second closure part, is arranged at the outer side of the side wall of the container by means of which actuation element the snap-in connection can be released between the two closure parts.

20. The lockout box in accordance with claim 18, wherein the second closure part can be deflected from a position of rest into a release position, in which the snap-in connection is released, by means of the actuation element; and wherein the second closure part is formed resilient such that, in the release position, the second closure part is acted on by a restoring force into the position of rest.

21. The lockout box in accordance with claim 18, wherein at least one spring is provided which preloads the cover in the direction of the open position.

22. The lockout box in accordance with claim 18, wherein the width of the rear side wall is in a range between twice and three times the width of the lateral side walls.

* * * * *